US007410272B2

(12) United States Patent
Halasz

(10) Patent No.: US 7,410,272 B2
(45) **Date of Patent: *Aug. 12, 2008**

(54) LIGHTING DEVICE

(75) Inventor: Christopher Lee Halasz, Parker, CO (US)

(73) Assignee: Mag Instrument, Inc., Ontario, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/607,259

(22) Filed: Dec. 1, 2006

(65) Prior Publication Data

US 2007/0076410 A1 Apr. 5, 2007

Related U.S. Application Data

(63) Continuation of application No. 11/137,214, filed on May 24, 2005, now abandoned, which is a continuation of application No. 09/927,484, filed on Aug. 10, 2001, now Pat. No. 6,905,223.

(60) Provisional application No. 60/224,313, filed on Aug. 10, 2000.

(51) Int. Cl.
*F21L 4/04* (2006.01)

(52) U.S. Cl. ..... 362/296; 362/197; 362/287

(58) Field of Classification Search ..... 362/197, 362/287, 427

See application file for complete search history.

(56) References Cited

U.S. PATENT DOCUMENTS

| | | | |
|---|---|---|---|
| 555,183 | A | 2/1896 | Rhind |
| 577,156 | A | 2/1897 | Bragger |
| 926,114 | A | 6/1909 | Hall |
| 1,186,428 | A | 6/1916 | Newman |
| 1,513,211 | A | 10/1924 | Barany |
| 1,584,539 | A | 5/1926 | Hopkins |
| 1,603,272 | A | 10/1926 | Eaton |
| 1,608,195 | A | 11/1926 | Barany |
| 1,638,716 | A | 8/1927 | Surles |
| 1,644,126 | A | 10/1927 | Harris |
| 1,674,650 | A | 6/1928 | Leser |
| 1,680,169 | A | 8/1928 | Osean |
| 1,680,188 | A | 8/1928 | Weber |

(Continued)

FOREIGN PATENT DOCUMENTS

| | | |
|---|---|---|
| AU | 114558 | 1/1942 |

(Continued)

*Primary Examiner*—Anabel M Ton
(74) *Attorney, Agent, or Firm*—Jones Day

(57) ABSTRACT

A portable, battery-operated flashlight having improved pivoting, switching and focusing features is disclosed. In one aspect of the invention, the flashlight takes the form of an attachment to a head gear for hands free use. In another aspect of the invention, the flashlight takes the form of a head lamp held in place on an user's head by an elastic band. The pivot connection between the body and the base, as well as the serrations on an exterior surface of the body, allows a user to adjust any angular direction of the light as desired. In another aspect of the invention, the flashlight takes the form of a long-handled flashlight having improved switching and focusing capabilities, such that axial movement of the switching assembly turns the flashlight "on" or "off," as well as causing a position of the lamp to vary in order to focus or defocus the light.

7 Claims, 12 Drawing Sheets

U.S. PATENT DOCUMENTS

| | | | | |
|---|---|---|---|---|
| 1,722,773 | A | 7/1929 | Stewart | |
| 1,758,835 | A | 5/1930 | Hime | |
| 1,823,762 | A | 9/1931 | Rathmann | |
| 1,851,503 | A | 3/1932 | Flamm | |
| 2,016,819 | A | 10/1935 | Meginniss | 240/10.66 |
| 2,097,222 | A | 10/1937 | Tompkins et al. | 240/10.66 |
| 2,173,650 | A | 9/1939 | Fullmer | 240/10.66 |
| 2,176,301 | A | 10/1939 | Haas | 240/10.66 |
| 2,212,103 | A | 8/1940 | Rothenberg et al. | 240/10.69 |
| 2,259,106 | A | 10/1941 | Hager | 200/60 |
| 2,272,907 | A | 2/1942 | Deibel | 240/10.61 |
| 2,338,078 | A | 12/1943 | Wood | 240/10.66 |
| 2,339,356 | A | 1/1944 | Sachs | 240/10.69 |
| 2,396,046 | A | 3/1946 | Hipwell et al. | 240/10.66 |
| 2,442,736 | A | 6/1948 | Valentine | 248/124 |
| 2,490,830 | A | 12/1949 | Norton | 240/10.68 |
| 2,530,913 | A | 11/1950 | Shackel | 240/10.6 |
| 2,599,295 | A | 6/1952 | Thomas | 200/60 |
| 2,915,621 | A | 12/1959 | Garland | 240/10.66 |
| 2,931,005 | A | 3/1960 | Saurwein et al. | 339/182 |
| 2,945,944 | A | 7/1960 | Gillespie | 240/10.68 |
| 3,014,125 | A | 12/1961 | Draudt | 240/10.66 |
| 3,076,891 | A | 2/1963 | Moore | 240/10.66 |
| 3,652,846 | A | 3/1972 | Starck, II | 240/10.63 |
| 4,114,187 | A | 9/1978 | Uke | 362/158 |
| 4,151,583 | A | 4/1979 | Miller | 362/205 |
| 4,170,337 | A | 10/1979 | Davis | 248/475 |
| 4,220,985 | A | 9/1980 | Hukuba | 362/203 |
| 4,286,311 | A | 8/1981 | Maglica | 362/205 |
| 4,388,673 | A | 6/1983 | Maglica | 362/183 |
| 4,398,238 | A | 8/1983 | Nelson | 362/187 |
| 4,399,498 | A | 8/1983 | Bacevius | 362/396 |
| 4,429,351 | A | 1/1984 | Petz et al. | 362/187 |
| 4,472,766 | A | 9/1984 | Hung | 362/158 |
| 4,495,551 | A | 1/1985 | Foltz | 362/205 |
| 4,506,317 | A | 3/1985 | Duddy | 362/396 |
| 4,527,223 | A | 7/1985 | Maglica | 362/187 |
| 4,531,178 | A | 7/1985 | Uke | 362/158 |
| 4,570,208 | A | 2/1986 | Sassmannshausen | 362/188 |
| 4,577,263 | A | 3/1986 | Maglica | 362/187 |
| 4,581,686 | A | 4/1986 | Nelson | 362/204 |
| 4,618,081 | A | 10/1986 | Miree | 224/41 |
| 4,656,565 | A | 4/1987 | Maglica | 362/187 |
| 4,658,336 | A | 4/1987 | Maglica | 362/197 |
| 4,725,932 | A | 2/1988 | Gammache | 362/202 |
| 4,733,337 | A | 3/1988 | Bieberstein | 362/206 |
| 4,777,572 | A | 10/1988 | Ambasz | 362/197 |
| 4,777,582 | A | 10/1988 | Sharrah | 362/205 |
| 4,819,141 | A | 4/1989 | Maglica et al. | 362/207 |
| 4,823,242 | A | 4/1989 | Maglica et al. | 362/187 |
| 4,841,417 | A | 6/1989 | Maglica et al. | 362/206 |
| 4,843,526 | A | 6/1989 | Price, III | 362/187 |
| 4,851,974 | A | 7/1989 | Maglica | 362/187 |
| 4,864,474 | A | 9/1989 | Maglica | 362/203 |
| 4,870,550 | A | 9/1989 | Uke | 362/158 |
| 4,888,670 | A | 12/1989 | Sharrah | 362/205 |
| 4,899,265 | A | 2/1990 | Maglica | 362/187 |
| 4,907,141 | A | 3/1990 | Wang | 362/205 |
| 4,914,555 | A | 4/1990 | Gammache | 362/183 |
| 4,942,505 | A | 7/1990 | Maglica | 362/187 |
| 4,951,183 | A | 8/1990 | Wang | 362/187 |
| 4,956,755 | A | 9/1990 | Maglica et al. | 362/206 |
| 4,967,325 | A | 10/1990 | Shiau | 362/188 |
| 4,980,805 | A | 12/1990 | Maglica et al. | 362/72 |
| 4,999,750 | A | 3/1991 | Gammache | 362/203 |
| 5,043,854 | A | 8/1991 | Gammache | 362/197 |
| 5,062,026 | A | 10/1991 | Maglica et al. | 362/72 |
| 5,109,321 | A | 4/1992 | Maglica et al. | 362/72 |
| 5,113,326 | A | 5/1992 | Maglica | 362/158 |
| 5,122,938 | A | 6/1992 | Pastusek | 362/203 |
| 5,124,894 | A | 6/1992 | Shiau | 362/187 |
| 5,126,927 | A * | 6/1992 | Reeves et al. | 362/187 |
| 5,128,841 | A | 7/1992 | Maglica et al. | 362/72 |
| 5,138,537 | A | 8/1992 | Wang | 362/187 |
| 5,143,441 | A | 9/1992 | Maglica | 362/263 |
| 5,158,358 | A | 10/1992 | Maglica et al. | 362/206 |
| 5,161,095 | A | 11/1992 | Gammache | 362/197 |
| 5,184,884 | A | 2/1993 | Maglica et al. | 362/72 |
| 5,213,408 | A | 5/1993 | Shiau | 362/187 |
| 5,260,858 | A | 11/1993 | Maglica | 362/205 |
| 5,270,911 | A | 12/1993 | Maglica et al. | 362/396 |
| 5,293,307 | A | 3/1994 | Maglica | 362/203 |
| 5,309,337 | A | 5/1994 | Groben | 362/206 |
| 5,345,370 | A | 9/1994 | Murray et al. | 362/205 |
| 5,400,227 | A | 3/1995 | Maglica et al. | 362/206 |
| 5,515,246 | A | 5/1996 | Maglica | 362/72 |
| 5,541,822 | A | 7/1996 | Bamber | 362/190 |
| 5,605,394 | A * | 2/1997 | Chen | 362/197 |
| 5,660,363 | A | 8/1997 | Maglica | 248/288.31 |
| 5,667,185 | A | 9/1997 | Maglica | 248/541 |
| 5,806,964 | A | 9/1998 | Maglica | 362/203 |
| 5,816,684 | A | 10/1998 | Yu | 326/191 |
| 5,860,728 | A | 1/1999 | Maglica | 362/191 |
| 6,004,008 | A | 12/1999 | Lai | 362/280 |
| 6,045,236 | A | 4/2000 | Cheng et al. | 362/188 |
| 6,170,960 | B1 | 1/2001 | Maglica | 362/205 |
| 6,186,638 | B1 | 2/2001 | Chang | 362/119 |
| 6,193,388 | B1 | 2/2001 | Halasz et al. | 362/205 |
| 6,457,838 | B1 | 10/2002 | Dungmore et al. | 362/106 |
| 6,905,223 | B2 * | 6/2005 | Halasz | 362/197 |

FOREIGN PATENT DOCUMENTS

| | | |
|---|---|---|
| GB | 549104 | 11/1942 |
| GB | 90 30 6589 | 8/1990 |
| GB | 2 091 863 A | 8/1992 |
| GB | 2 263 162 B | 7/1993 |

* cited by examiner

LIGHTING DEVICE

PRIORITY

This application is a continuation of U.S. patent application Ser. No. 11/137,214, filed May 24, 2005 now abandoned, now pending, which is a continuation of U.S. patent application Ser. No. 09/927,484, filed Aug. 10, 2001, now U.S. Pat. No. 6,905,223, which in turn claimed priority to U.S. Patent Application Ser. No. 60/224,313, filed Aug. 10, 2000. The foregoing applications are incorporated by reference as if fully set forth herein.

FIELD OF INVENTION

The present invention relates to the field of portable, battery-operated flashlights. More particularly, the present invention relates to a portable, battery-operated flashlight having improved pivoting features such that it may be worn as a head lamp. In another aspect of the invention, the portable, battery-operated flashlight has improved switching and focusing features such that the lamp's position in the reflector may be varied to focus or defocus the light from the lamp.

BACKGROUND OF INVENTION

Flashlights generally include a battery chamber for retaining one or more batteries, a light bulb electrically connected to the one or more batteries, and a reflector for reflecting the light from the light bulb in a particular direction. The electrical connection between the batteries and the light bulb usually includes a switch mechanism for selectively providing electrical energy from the batteries to the light bulb and, therefore, enabling the flashlight to be turned on and off.

A primary function of flashlights is to provide a convenient portable, storable light source that is capable of projecting light in a particular direction. However, it is difficult in some flashlights to project light in a particular direction because of the stationary nature and fixed connectivity of flashlight parts relative to each other. In addition, the difficulty of light projection in a desired direction may be also limited by the inflexible nature of the reflector.

SUMMARY OF INVENTION

The present invention satisfies, to a great extent, the foregoing and other needs not currently satisfied by existing flashlights. This result is achieved, in an exemplary embodiment, by a portable, battery-operated flashlight having an improved pivot point for the lamp portion. In this embodiment, the flashlight takes the form of an attachment usable as a head worn lamp, which may be attached to head gear such as a safety helmet or include an elastic band to secure the flashlight to a user's head.

The flashlight comprises a body, a base portion and a lamp. The body is for retaining at least one battery, and has a serrated-like surface on an exterior surface to facilitate desired angular adjustment of the body, and thus the light. Preferably, the body comprises a top portion and a bottom portion, which contains the serrations. The base portion is pivotally connected to the body at two points, and has pivot stops therein to adjust the body angularly as desired. Preferably, the base portion is affixable to a head gear. The lamp is removably attached to the body, and selectively connected to the battery to cause the lamp to emanate light.

The pivot connection between the base portion and the body allows a low profile positioning of the lamp with respect to a user's desired line of lighted vision. The pivot connection allows for 180 degree angular adjustment of the body and lamp with respect to the base portion. The pivot stops located on the base portion also allow for 180 degree angular adjustment of the body with respect to the base portion. This is achieved when the pivot stops mate with the serrated edges on the body.

In another aspect of the invention, a flashlight having improved switching and focusing features is disclosed. Here, the portable, battery-operated flashlight takes the form of a long-handled flashlight which construction allows variation in the ability to focus and defocus the lamp's light. The flashlight comprises a body, lamp, head assembly and switching assembly. The body retains at least one battery. The lamp, which is removably attached to the body, is selectively connected to the battery to cause the lamp to emanate light. The switching assembly is movable relative to the head assembly such that axial movement of the switching assembly causes electrical coupling of the lamp with the battery and causes a position of the lamp to vary to focus and defocus the light.

The head assembly comprises a bezel that is capable of radial movement to cause the switching assembly to move axially. In this regard, the switching assembly includes a first spring located most adjacent to the battery, and a second spring located most adjacent to the reflector. As the switching assembly moves axially, the first spring is caused to compress first to cause electrical coupling of the lamp with the battery. Once the switch assembly makes electrical contact with the battery, the second spring compresses to cause the position of the lamp to vary within the reflector to cause focusing and defocusing of the light emanating from the lamp.

With these and other advantages and features of the invention that may become hereinafter apparent, the nature of the invention may be more clearly understood by reference to the following detailed description of the invention, the appended claims and to the several drawings attached herein.

DETAILED DESCRIPTION OF PREFERRED EMBODIMENTS

Figure 1:
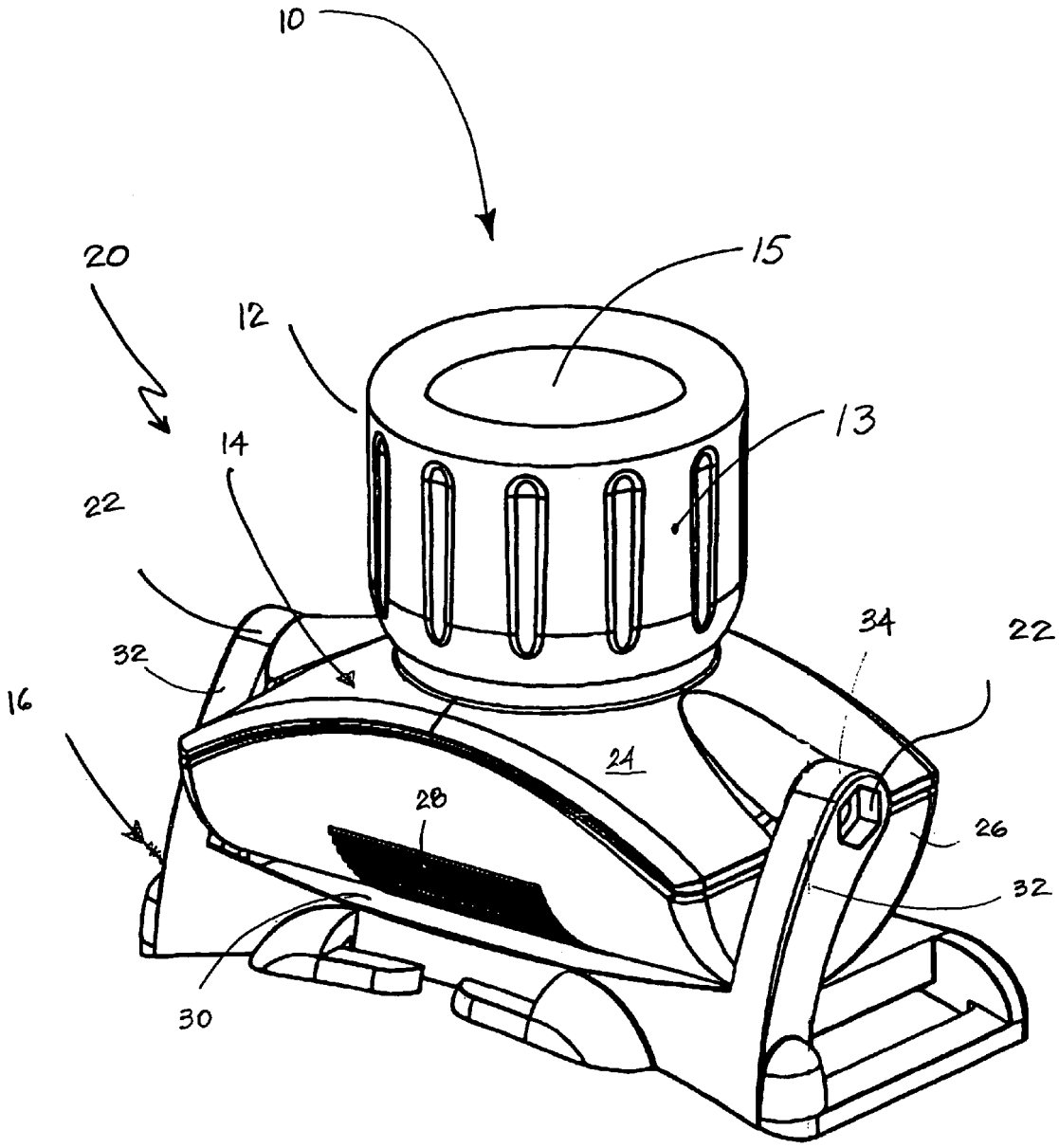
FIG. 1 is a perspective front view of a head worn flashlight in accordance with an exemplary embodiment of the present invention.

Referring now to the figures, wherein like reference numerals indicate like elements, in FIG. 1 there is shown a perspective front view of a head worn flashlight 10 in accordance with an exemplary embodiment of the present invention. As depicted, flashlight 10 is shown as having a head assembly 12, a body 14 and a base 16, which may serve as an attachment portion. The head assembly 12 and body 14 generally comprise the head light 20.

The head assembly 12 comprises a bezel 13, a switch assembly (not shown), a lamp (not shown), reflector (not shown) and lens 15. In this embodiment, the bezel 13 is capable of radial movement (i.e., rotation) to cause the switch to selectively connect the lamp to the one or more batteries, and therefore cause the lamp to emanate light. Further, the bezel 13 is capable of radial movement to cause focusing and defocusing of light from the lamp. The reflector directs light from the lamp through the lens. The head light 20 of the flashlight 10 is assembled by attaching the head assembly 12 and switch assembly to the body 14, such that the lamp is positioned in the switch assembly and is in alignment with the reflector via an opening in the reflector. The head assembly 12 is removably attached to the body 14.

Figure 2:
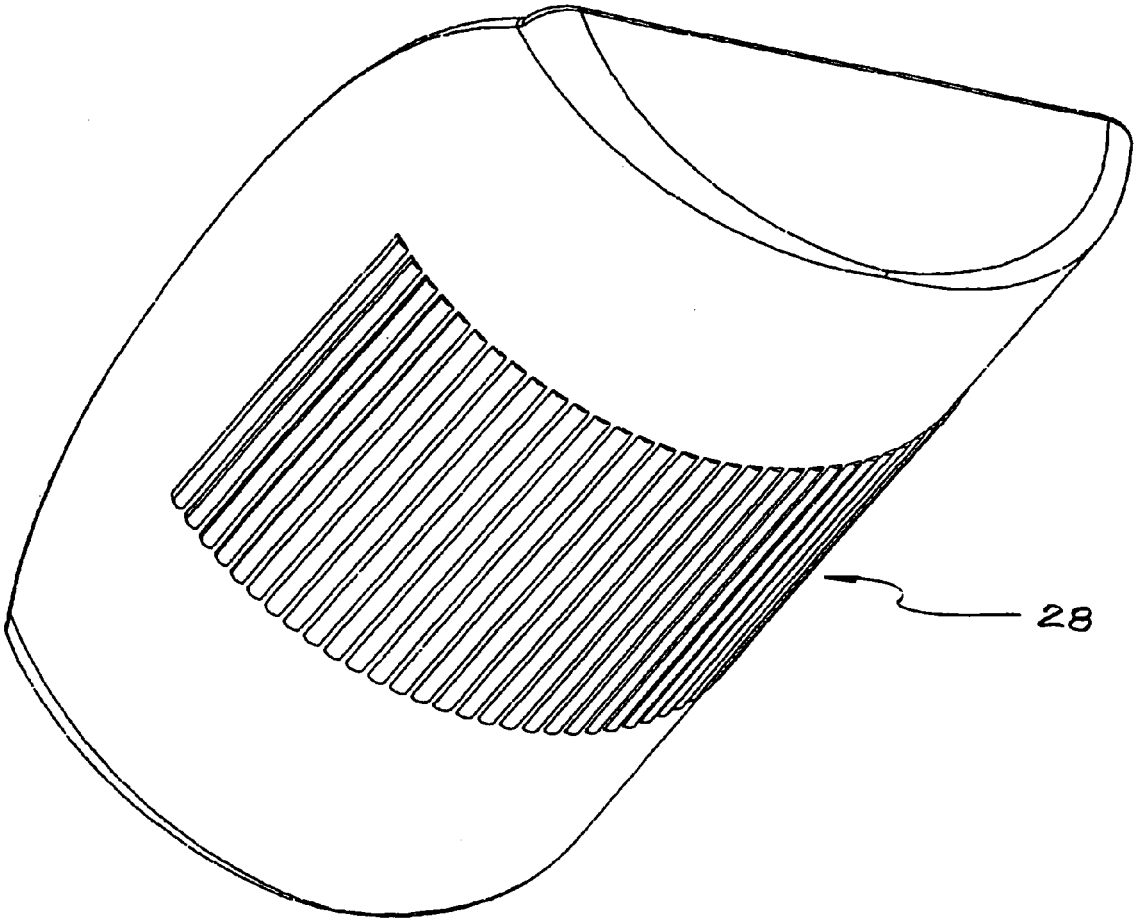
FIG. 2 is a close up view of a preferred embodiment of the serrations on the body.
Figure 3:
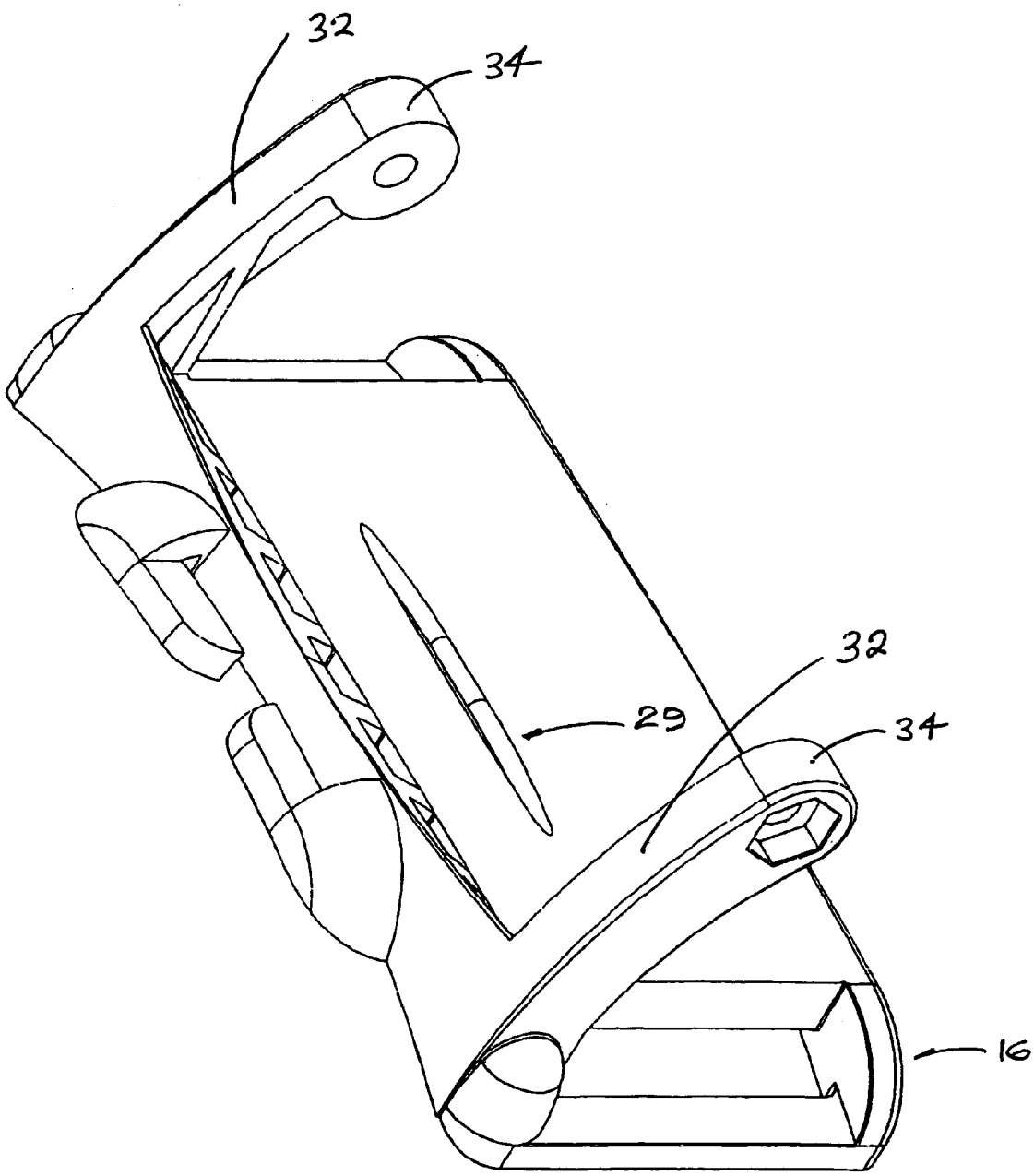
FIG. 3 is a close up view of a preferred embodiment of the pivot stop on the base.

The body 14 serves as a chamber for holding one or more batteries in a series arrangement. The body 14 comprises a top portion 24 and a bottom portion 26. The top portion 24 is removably attached to the bottom portion 26 to selectively uncover the interior portion of the body 14 to allow, among other things, the one or more batteries to be inserted or removed. Referring to FIGS. 1 and 2, the body 14 also includes, in a mid-region of the bottom portion 26, serrations 28 on an exterior surface of the body 14 for engaging a surface 30 of the base 16. A close-up view of a preferred embodiment of serrations 28 is shown in FIG. 2. Serrations 28 facilitate desired angular adjustment of the body 14 and head assembly 12 with respect to the base 16. This is accomplished when serrations 28 mate with the pivot stop 29 located on base 16, as shown in FIG. 3.

In general, movement of the body 14 is achieved by two pivot connection points 22 at each end of the body 14 to the base 16. The substantially flat, arched undersurface (not shown) of the base 16 facilitates standing of the flashlight 10 on a flat surface. It also facilitates attachment of the base 16 to a curved surface object, such as head gear, or placement directly on a human forehead. In this regard, attachment of the flashlight 10 to a safety helmet, for example, allows desired positioning of the direction of the light emanating from the lamp while providing more stability. Another advantage of the attachment feature of base 16 is hands free use of the flashlight 10.

Figure 4:
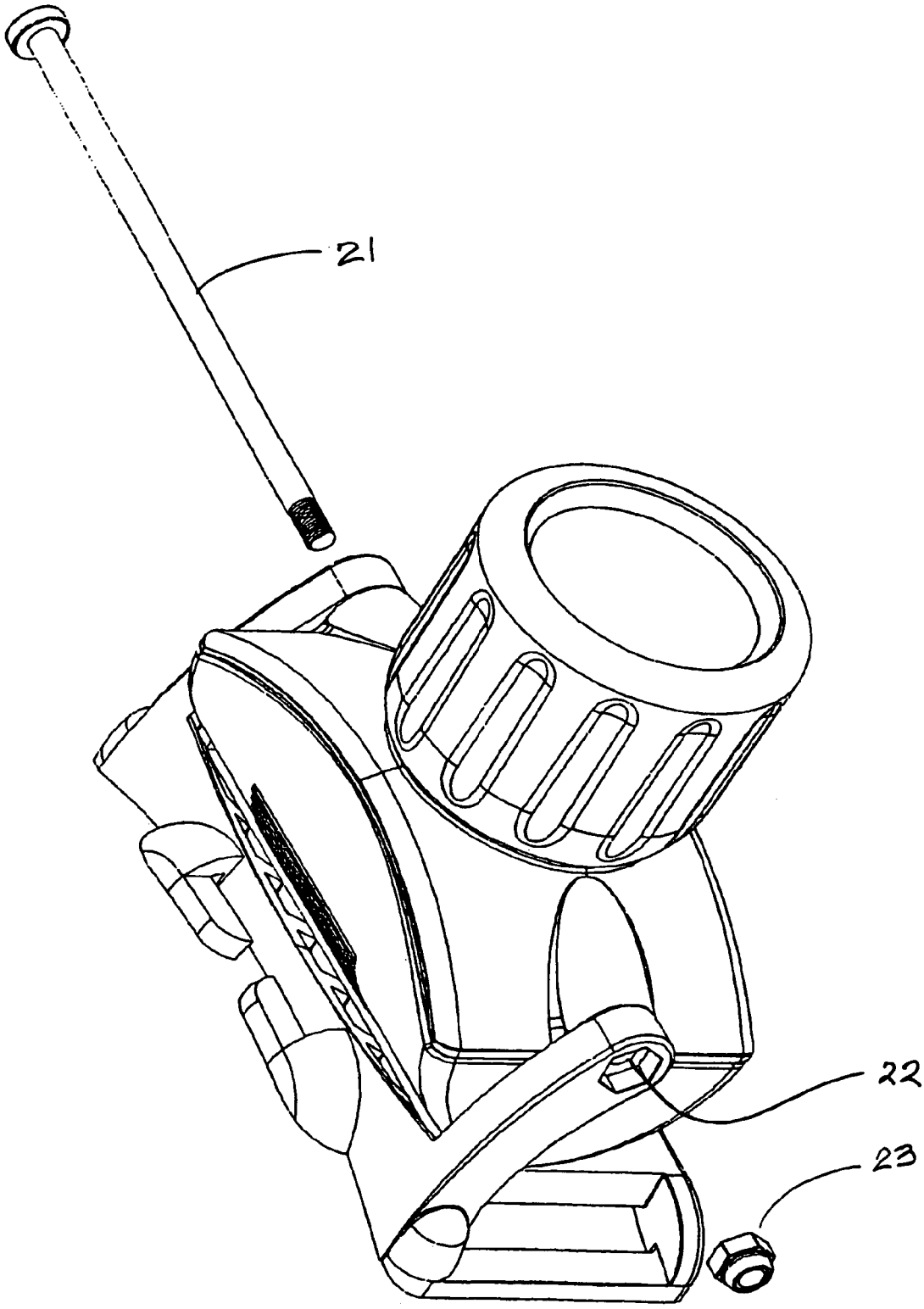
FIG. 4 is an exploded view of the pivot connection in accordance with the present invention.
Figure 5:
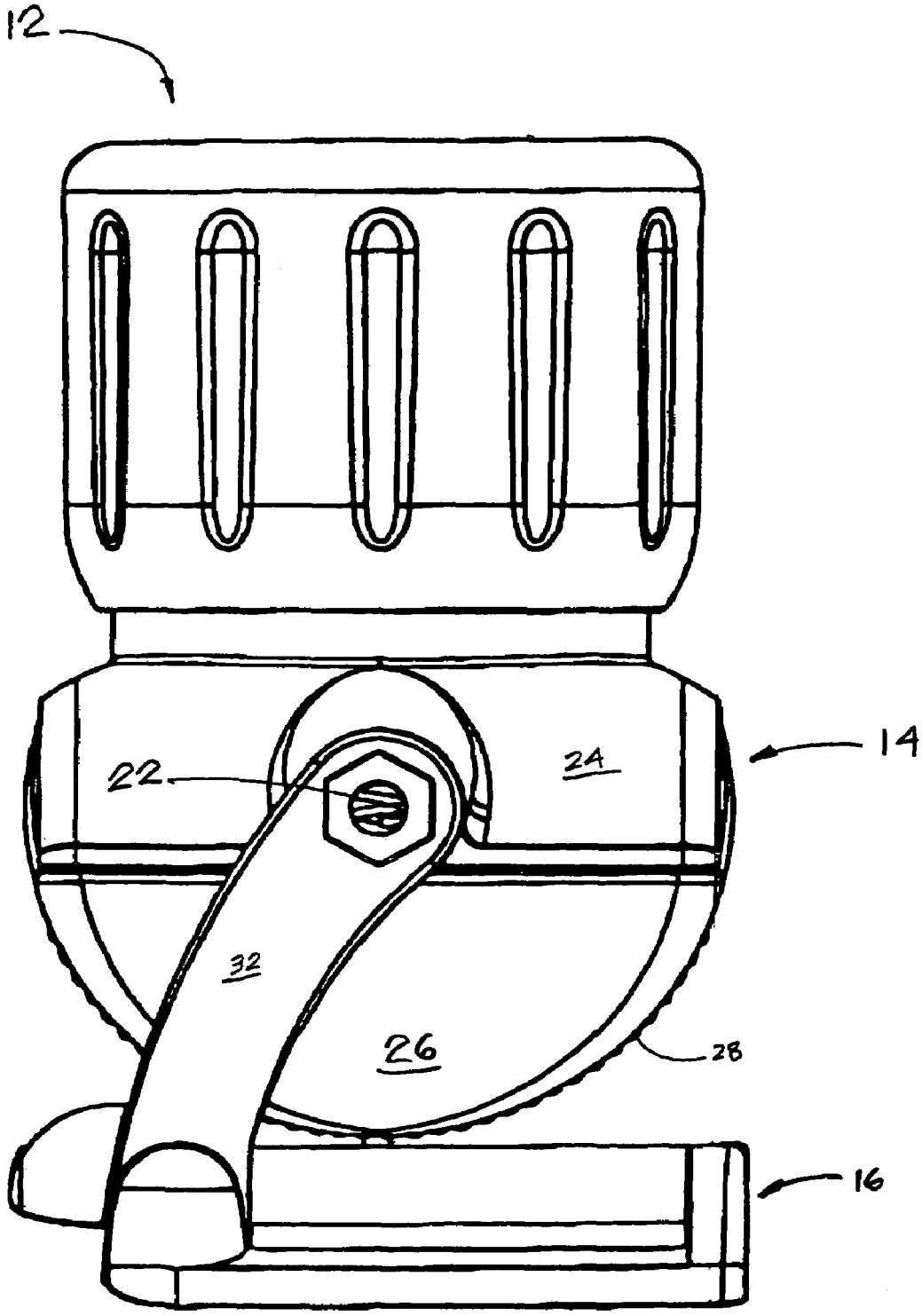
FIG. 5 is another view of the flashlight of the present invention.

In the embodiment depicted, the base 16 is rectangular in shape and has an arm 32 projecting from each base end. A distal end 34 of the arm 32 is the location area of the pivot point 22 connecting the body 14 to the base 16. As shown in FIG. 4, screw 21 engages nut 23 to form pivot point 22. As shown in FIG. 5, use of the serrations 28 in conjunction with pivot point 22 allows for 180 degree angular adjustment of the body 14, and consequently the head light 12, with respect to the base 16. Additionally, when the flashlight 10 is used as a head lamp, the pivot point 22 allows the body 14 to maintain contact with the base 16.

Figure 6:
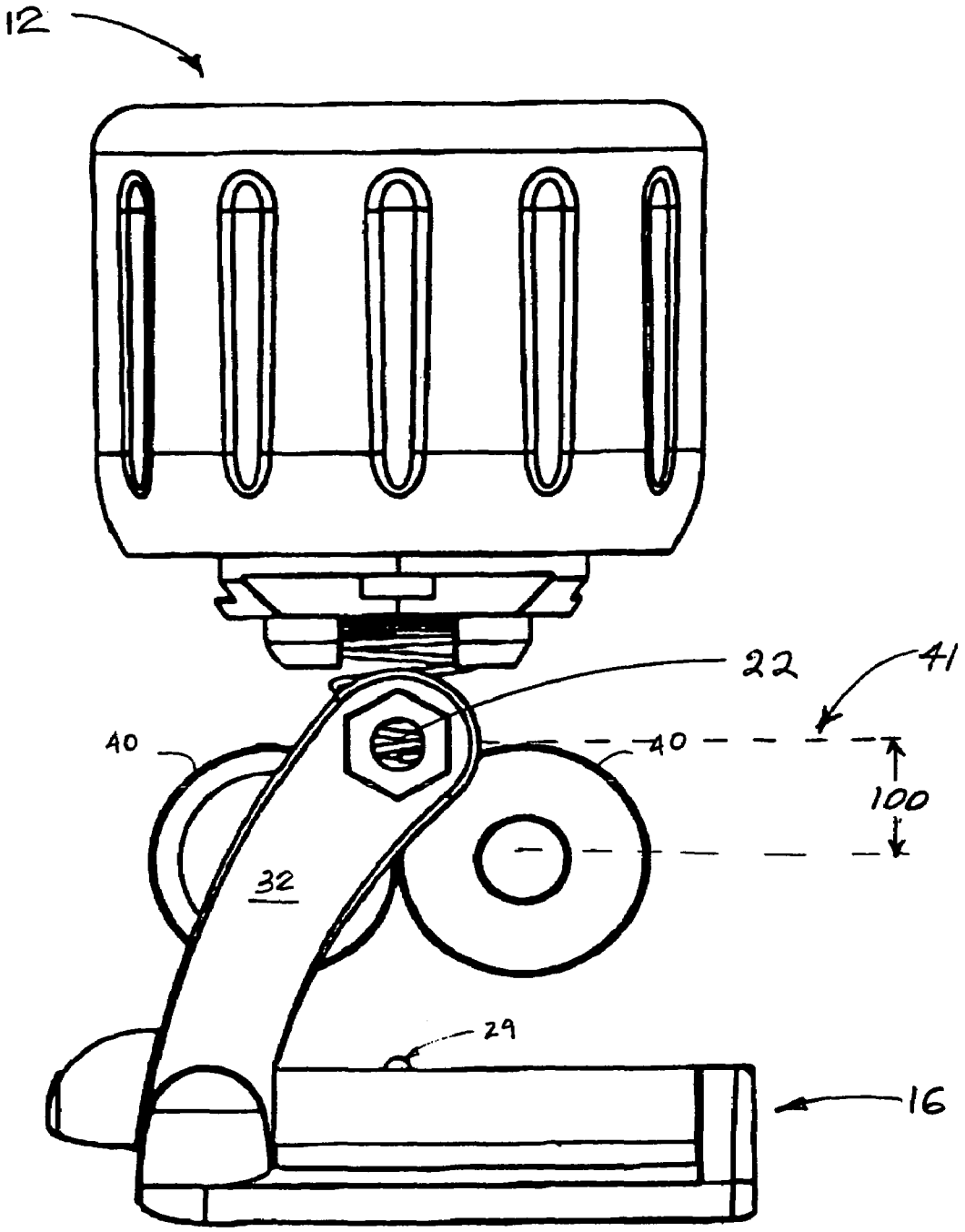
FIG. 6 is a view showing the removed body of the flashlight.

Referring now to FIG. 6, there is shown a view of the flashlight showing removal of the body 14 casing, which covered the batteries 40. In the embodiment depicted, the two batteries 40 are exposed to illustrate that the pivot point 22 is spatially located at a distance 100 from the plane that intersects a center point of each battery. In this regard, the pivot point 22 is located between the batteries and the head assembly 12. Preferably, the pivot point 22 is located substantially along the tangent plane 41 of the two batteries 40. This advantageously facilitates the balanced positioning of the head assembly 12 and comfort for a user wearing the device.

Referring now to FIGS. 7-12, there is shown a long-handled flashlight having improved switching and focusing features in accordance with another embodiment of the present invention. It is important to note that the improved switching and focusing features described below and shown in FIGS. 7-12 are applicable to the head light 20 described above and shown in FIGS. 1-6. As depicted, the flashlight is shown as having a head assembly 62, a body 64 and a switching assembly 65. The head assembly 62 comprises a lamp 68, a reflector 70, a bezel 72, and a lens 73. The switching assembly 65 includes a first spring 66, a second spring 74, a first electrical contact 80 and a second electrical contact 82. The lamp 68 (partially shown) includes a first pin 84 that contacts the first electrical contact 80 and a second pin 86 that contacts the second electrical contact 82. The second pin 86 is electrically connected to the first spring 66 that is in electrical contact with one of the batteries 76. The body 64 includes a chamber contact 88 that runs the length of the body 64 and is capable of electrical connection to batteries 76 located within the body 64. A description of the switching, focusing and defocusing aspects of the flashlight is explained below with reference to FIGS. 7-12.

Figure 7:
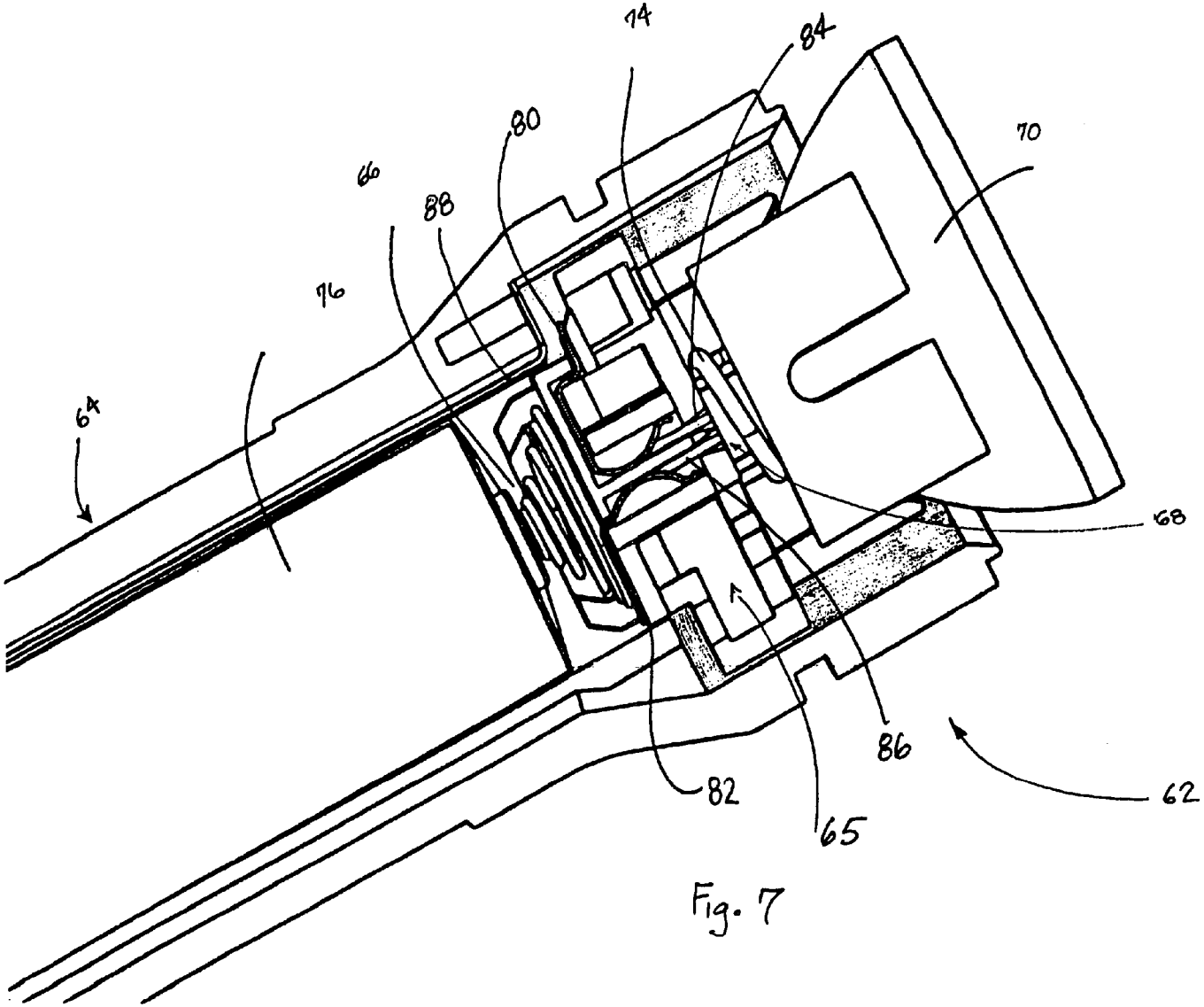
FIG. 7 is cross-sectional front view of a long-handled flashlight (without bezel) showing readiness of the reflector to move in the direction towards the batteries.
Figure 8:
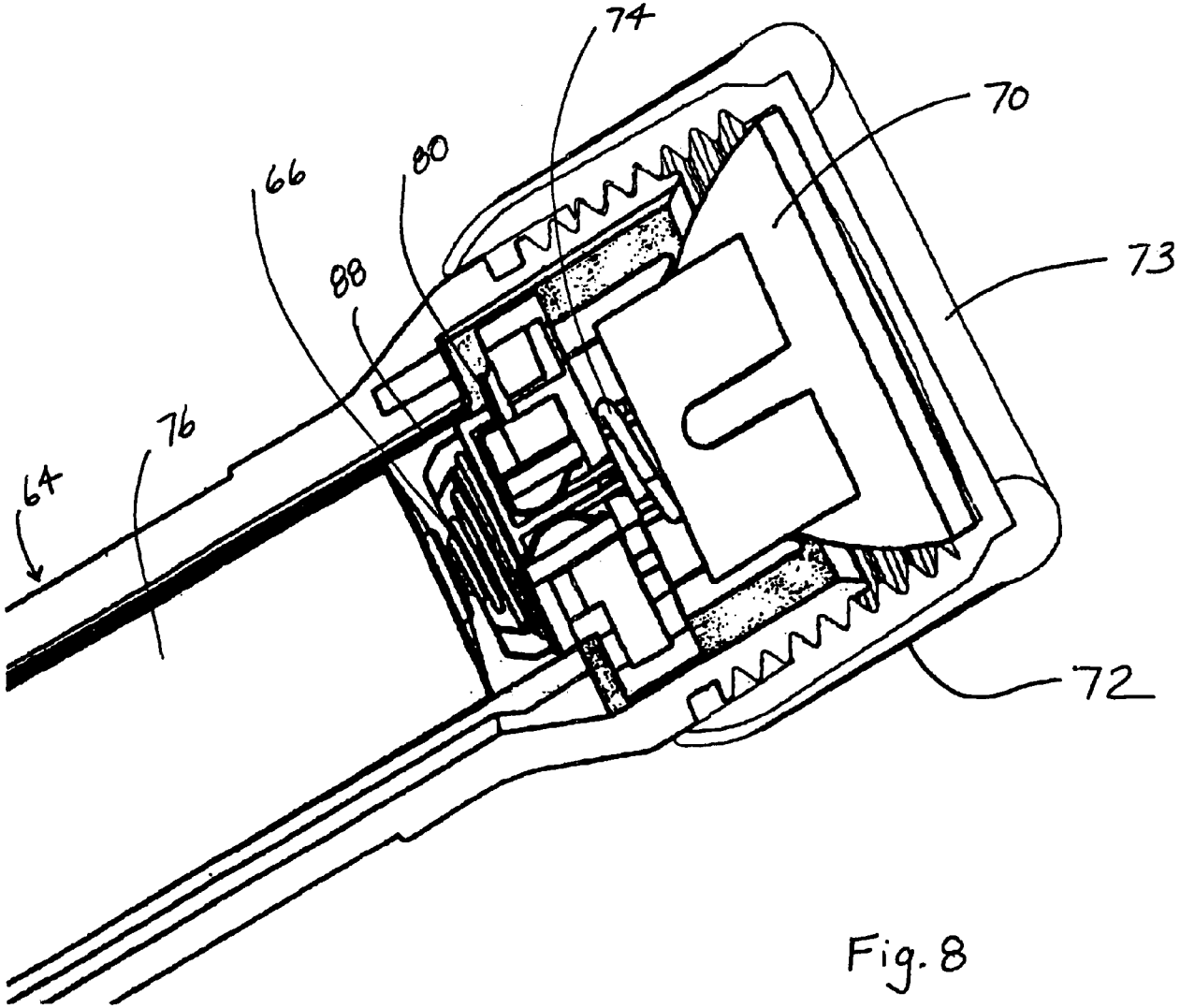
FIG. 8 is cross-sectional front view of a long-handled flashlight (with bezel) showing readiness of the reflector to move in the direction towards the batteries.

Referring to FIGS. 7 and 8, the flashlight is shown in the "off" position. In this position, the switching assembly 65 is permitted to move towards and away from the body 64 (i.e. axially). Axial movement of the switching assembly 65 is achieved by radial movement of the bezel 72. In this regard, the bezel 72 is capable of radial movement that causes the bezel 72 to move axially towards the battery 76. The bezel 72 is in contact with the reflector 70, and the reflector is in contact with the second spring 74. As a result of radial movement of the bezel 72, the reflector 70 moves axially towards the battery 76.

Figure 9:
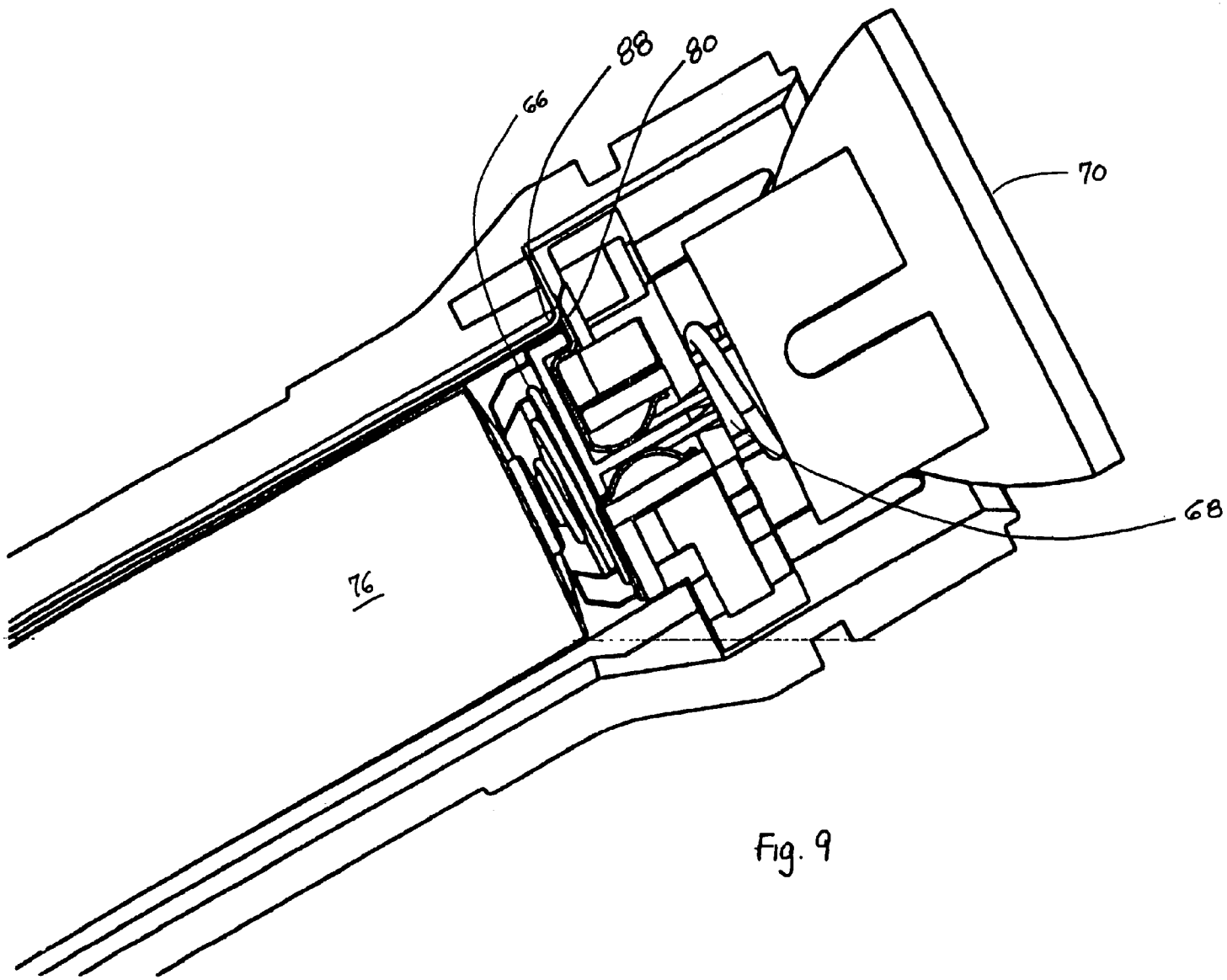
FIG. 9 is a cross-sectional front view of the flashlight of FIG. 7 showing the switching assembly is in the "on" position.
Figure 10:
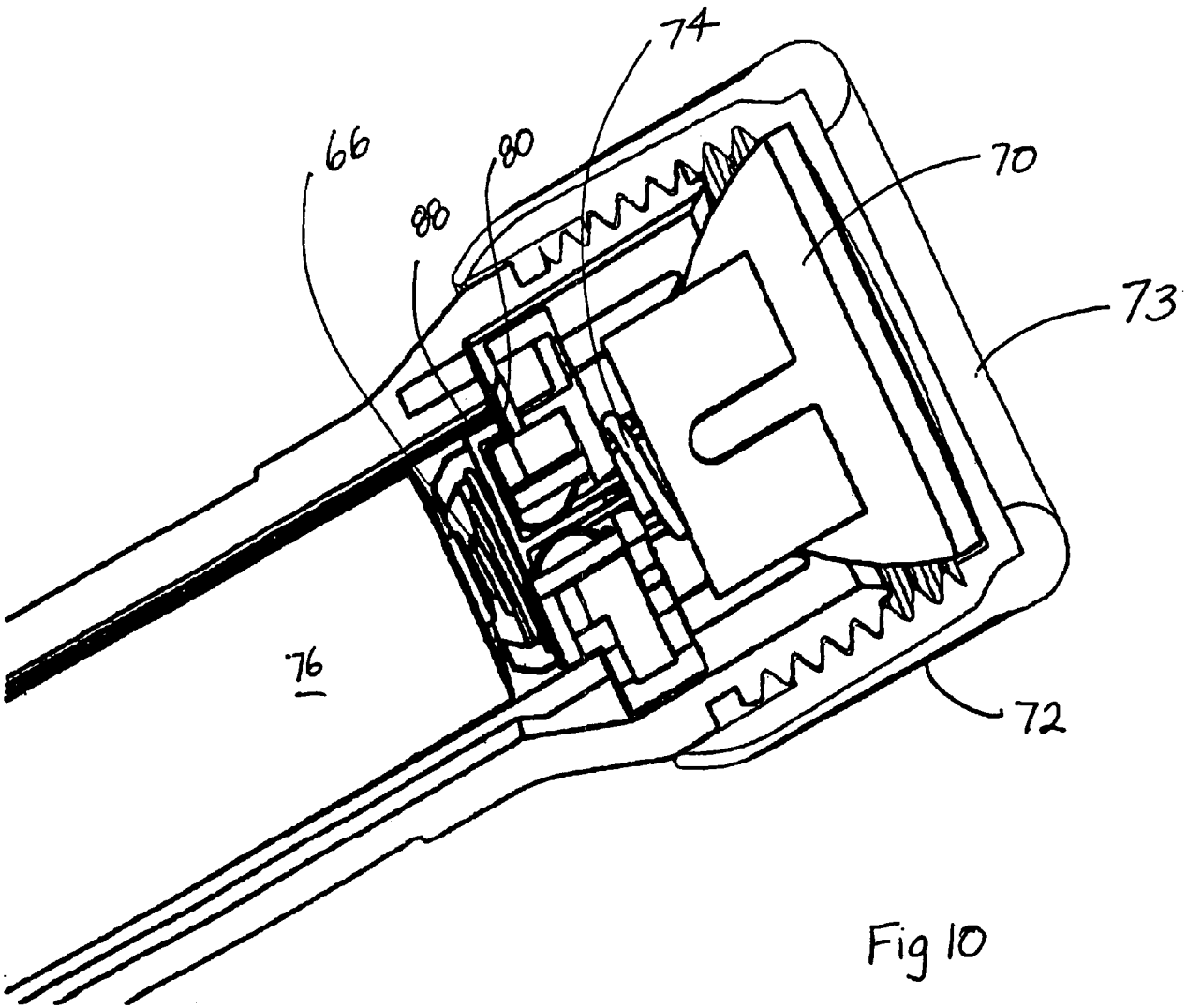
FIG. 10 is a cross-sectional front view of the flashlight of FIG. 8 showing the switching assembly is in the "on" position.

Referring now to FIGS. 9 and 10, the flashlight is shown in the "on" position. Noteworthy is the collapsed position of the first spring 66. The second spring 74 is not collapsed. This is accomplished by turning or rotating the bezel 72. As the bezel is rotated, the reflector 70 is caused to move axially towards the battery 76. The compression force of the first spring 66 and the second spring 74 are selected to allow the first spring 66 to substantially collapse before the second spring 74. As a result, as the bezel 72 is rotated, the reflector 70 exerts a downward axial compressive force, causing the first spring 66 only to collapse. At this juncture, the second spring 74 does not collapse during this movement and, as a result, the reflector 70 and the switching assembly move together towards the batteries 76. The compression of the first spring 66 causes the lamp 68 to turn on because an electrical connection is made with the batteries 76. In this regard, the first electrical contact 80 contacts the chamber contact 88 causing a completion of the electrical connection between the first pin 84 and second pin 86 and the batteries 76.

Figure 11:
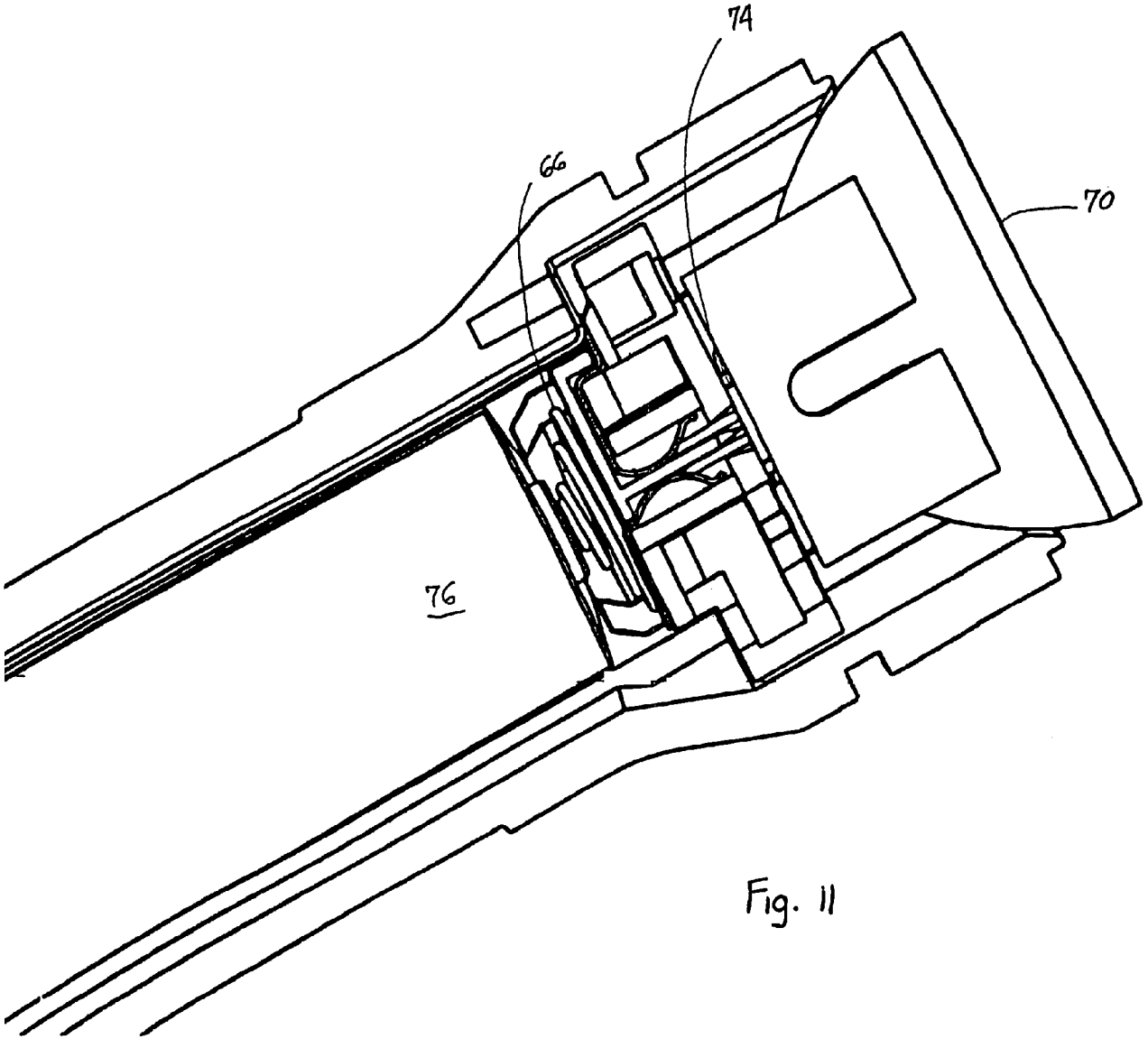
FIG. 11 is a cross-sectional front view of the flashlight of FIG. 7 showing compression of the second spring.
Figure 12:
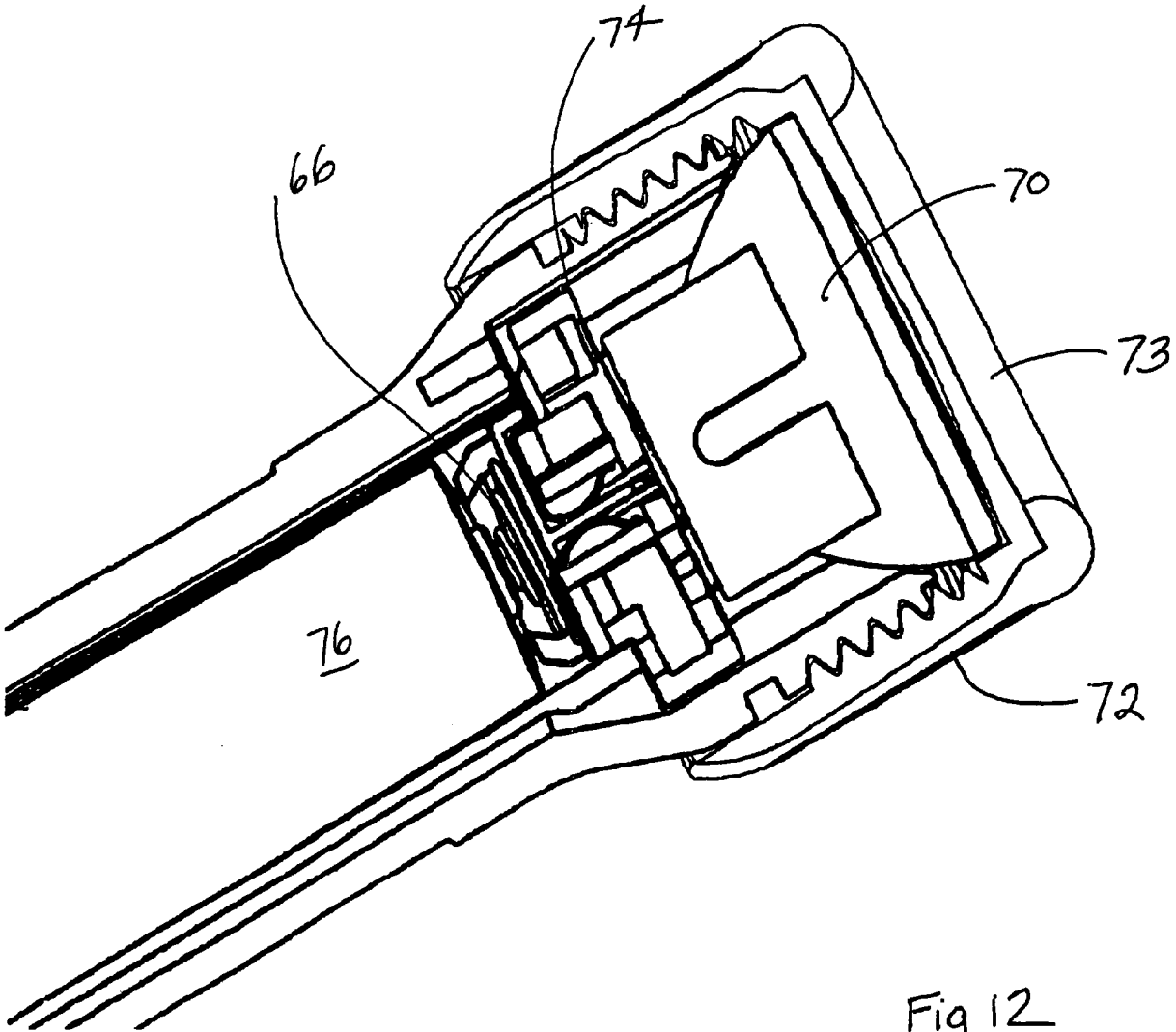
FIG. 12 is a cross-sectional front view of the flashlight of FIG. 8 showing compression of the second spring.

Referring now to FIGS. 11 and 12, there is shown the collapsed position of both the first spring 66 and the second spring 74. When the first electrical contact 80 contacts the chamber contact 88, and the bezel continues to rotate, further movement of the reflector 70 exerts additional compressive forces in the direction of the batteries 76, causing the second spring 74 to collapse. As a consequence, the reflector 70 is caused to move relative to the lamp 68 and the switching assembly. In other words, the practical effect of this condition is that the position of the lamp 68 within the reflector 70 can be varied as desired to focus or defocus the light from the lamp 68 through the lens 73, depending on where the lamp 68 is positioned within the reflector 70.

The head portion of the flashlight can be disassembled by rotating the bezel 72 from the "off" position in a direction opposite to the first rotation direction, thereby disengaging the second spring 74 and then the first spring 66 from electrical contact.

The foregoing description of the present invention has been presented for purposes of illustration and description. The description is not intended to limit the invention to the form disclosed herein. Consequently, the invention and modifications commensurate with the above teachings and skill and knowledge of the relevant art are within the scope of the present invention. It is intended that the appended claims be construed to include all alternative embodiments as permitted by the prior art.

What is claimed is:

1. A lighting apparatus, comprising:

a body for retaining at least one battery, said body having a plurality of serrations;

a base attached to said body by at least one pivot connection point, said base having a stop; and a light source, housed within said body, and selectively electrically connected to said at least one battery to cause said light source to emanate light;

wherein said stop is capable of engaging with one or more of said serrations to facilitate desired angular adjustment of light emanating from said light source.

2. A lighting apparatus, comprising:

a power supply;

a body having a plurality of serrations;

a base attached to said body by at least one pivot connection point, said base having a stop; and a light source, attached to said body, and selectively electrically connected to said power supply to cause said light source to emanate light;

wherein said stop is capable of engaging with one or more of said serrations to facilitate desired angular adjustment of light emanating from said light source.

3. A lighting apparatus, comprising:

a body for retaining at least one battery;

a light source;

a head capable of housing said light source, wherein said head is removably attached to said body and movement thereof selectively electrically connects said light source with said at least one battery; and a base, connected to said body, wherein at least one point of connection between said base and said body is located substantially between said at least one battery and said head to facilitate the balanced position of said head.

4. A lighting apparatus, comprising:

a body for retaining at least one battery;

a light source;

a reflector;

a head for retaining said reflector and said light source;

wherein said light source is capable of being selectively electrically connected to said at least one battery to cause said light source to emit light;

wherein axial movement of said head toward said body is capable of causing axial movement of said reflector together with said light source; and wherein further axial movement of said head toward said body is capable of causing axial movement of said reflector relative to said light source.

5. A lighting apparatus, comprising:

a body for retaining at least one battery;

a light source;

a reflector; and a head for retaining said reflector and said light source;

wherein said light source is capable of being selectively electrically connected to said at least one battery to cause said light source to emit light;

wherein axial movement of said reflector toward said body is capable of causing axial movement of said reflector together with said light source; and wherein further axial movement of said reflector toward said body is capable of causing axial movement of said reflector relative to said light source.

6. The lighting apparatus according to claim 5, wherein said head comprises a bezel and rotation of said bezel is capable of causing axial movement of said reflector toward said body.

7. A lighting apparatus including a switch assembly, comprising:

a reflector having a central opening;

a light source capable of protruding through the central opening of said reflector;

a first spring electrically connected to said light source, wherein compression of said first spring causes axial movement of said reflector together with said light source;

a second spring mechanically connected to said reflector, wherein compression of said second spring causes axial movement of said reflector relative to said light source; and wherein said second spring has a greater resistance to compression than said first spring.

* * * * *